United States Patent [19]

Delaplace et al.

[11] 4,438,707

[45] Mar. 27, 1984

[54] APPARATUS FOR DIRECTLY IGNITING LOW-GRADE SOLID FUEL POWDERS IN COLD COMBUSTION CHAMBERS

[75] Inventors: Lucien Delaplace, Sevres; Jacques Robert, Meudon, both of France

[73] Assignee: Stein Industrie, Velizy-Villacoublay, France

[21] Appl. No.: 346,708

[22] Filed: Feb. 8, 1982

[30] Foreign Application Priority Data

Feb. 6, 1981 [FR] France ..... 81 02383

[51] Int. Cl.[3] ..... F23D 1/02

[52] U.S. Cl. ..... 110/264; 110/263; 110/347

[58] Field of Search ..... 110/263, 347, 264

[56] References Cited

U.S. PATENT DOCUMENTS

| | | | |
|---|---|---|---|
| 3,934,522 | 1/1976 | Booker | 110/263 |
| 4,173,189 | 11/1979 | Cooper | 110/263 X |
| 4,221,174 | 9/1980 | Smith et al. | 110/263 X |
| 4,228,747 | 10/1980 | Smirlock et al. | 110/263 X |
| 4,241,673 | 12/1980 | Smith et al. | 110/347 |

FOREIGN PATENT DOCUMENTS

| | | |
|---|---|---|
| 922297 | 1/1955 | Fed. Rep. of Germany . |
| 928360 | 5/1955 | Fed. Rep. of Germany . |
| 2933040 | 8/1979 | Fed. Rep. of Germany . |
| 870016 | 11/1941 | France . |
| 2381242 | 2/1978 | France . |

*Primary Examiner*—Edward G. Favors

*Attorney, Agent, or Firm*—Sughrue, Mion, Zinn, Macpeak and Seas

[57] ABSTRACT

An apparatus allowing the use of low-grade solid fuel powders (coal, lignite, peat) and products derived therefrom during cold starting periods and for backing up combustion chamber operation at low load. The pilot burner (1) has an auxiliary and pilot igniter which burns gas produced by gasifying low-grade fuel in a gasification unit (6) and a main igniter which burns the low-grade fuel powder in a storage silo (5). The combustion air is heated in an air heater (10) by the gas produced by gasifying low-grade fuel in gasification unit (6). In particular, turbulence is set up in the combustion air sent to the outlet of the pilot igniter. Application to combustion apparatus including steam generators of thermal power stations.

10 Claims, 7 Drawing Figures

APPARATUS FOR DIRECTLY IGNITING LOW-GRADE SOLID FUEL POWDERS IN COLD COMBUSTION CHAMBERS

The present invention relates to an apparatus for directly igniting low-grade solid fuel powders in cold combustion chambers. These low-grade fuels are either coal whose ash content may be as much as 50%, with a volatile material content of less than 20%. Giving a lower heating power of about 8000 kilojoules per kilogram of fuel, or else they are lignite and peat whose water content may be up to 65% giving a lower heating power of the order of 6000 kilojoules per kilogram of fuel.

BACKGROUND OF THE INVENTION

When a steam generator is being cold started or is operating at low load ("load" here being used to mean the degree to which a boiler is being used relative to its capabilities) solid fuel powders are ignited by flames from high-grade fuels such as liquid or gaseous hydrocarbons. Initial ignition can be provided by diesel oil for example, followed by fuel oil and then the main solid fuel. This assistance may last up to three hours depending on the quality of the main solid fuel. This is the time necessary to reach a load of about of 35% to 40% which enables suitable stability flame to be obtained without assistance from high-grade fuel.

Further, assistance at low load is now being required more frequently than in the past, since fossil fuel boilers are being used more and more, not as base units but as auxiliary units, to powerful units which burn nuclear fuels and in which there is very little possibility of varying the load.

Therefore, the lower the grade of the main solid fuel, the higher the consumption of these auxiliary fuels (diesel oil light or heavy fuel oil, natural gas). This has a great incidence on running cost when it is necessary to import these fuels.

The main components of apparatus which equips a conventional installation are: a main combustion chamber; a pilot burner; a liquid fuel storage tank; and distribution pumps and storage cocks to bring the liquid fuel to a pilot igniter which forms part of the pilot burner. The pilot burner is disposed upstream from the main combustion chamber and the pilot igniter lies generally on the axis of the pilot burner which has a peripheral ring surrounding the pilot igniter to supply a mixture of solid fuel powder and so-called primary air under pressure to the main combustion chamber. So-called secondary air, also supplied under pressure, is provided at the combustion chamber.

One common particular prior art arrangement uses a liquid fuel which is particularly rich in calories for auxiliary ignition thus requiring only one pilot igniter of relatively small volume and capable of being disposed in a conventional configuration. Likewise, the combustion air is used only in the combustion chamber since combustion is thus sufficiently assisted.

Preferred embodiments of the apparatus in accordance with the present invention provide ignition and combustion support for solid fuel powders without using a high-grade auxiliary fuel which is expensive and sometimes difficult to obtain.

SUMMARY OF THE INVENTION

The present invention provides ignition apparatus for directly igniting low-grade solid fuel powders in cold combustion chambers, said apparatus comprising at least one pilot burner with at least one pilot igniter and at least one main igniter, these igniters being fed with low-grade fuel powders. The improvement lies wherein said pilot igniter is fed with low-grade gas coming from a gasifying unit for gasifying said low-grade fuel without adding any auxiliary high-grade fuel.

Usually, the ignition apparatus comprises a combustion chamber body having a cylindro-conical portion, which includes both air distribution units to facilitate combustion, and at least one pilot burner constituted by a pilot igniter and a main igniter which is fed by a pipe which brings in air and fuel powder and whose outlet is disposed axially relative to the cylindro-conical portion of the combustion chamber, wherein said low-grade gas pilot igniter is disposed upstream from said end of the fuel powder pipe in a position parallel to and to one side of said pipe.

In such a case the low-grade pilot igniter may be disposed upstream from said end of the fuel powder pipe in a position parallel to and to one side of said pipe, or else it may be disposed downstream from said end of the fuel powder pipe in a direction parallel to said pipe and having its outlet at a portion of the side surface of the conical part of the cylindro-conical portion of the combustion chamber.

In either case said air distribution units are preceded by an air heater which burns low-grade gas produced by said gasifying unit and supplying heated air to said pilot burner.

Said heated air may be fed to the inlet of said pilot igniter at the same time as the low-grade gas, while so-called secondary air, in which turbulence is set up, is fed to its outlet. In which case the turbulence in the secondary air may be set up by vanes disposed perpendicularly to the outlet of said pilot igniter of low-grade gas to make said secondary air rotate, or else the turbulence may be set up by a helical screw disposed concentrically around said powdered low-grade fuel.

BRIEF DESCRIPTION OF THE DRAWINGS

An embodiment of the invention is described by way of example with reference to the accompanying drawings in which.

Where the same part appears in several of the figures, it has the same reference numeral in each of them.

MORE DETAILED DESCRIPTION

Figure 1:
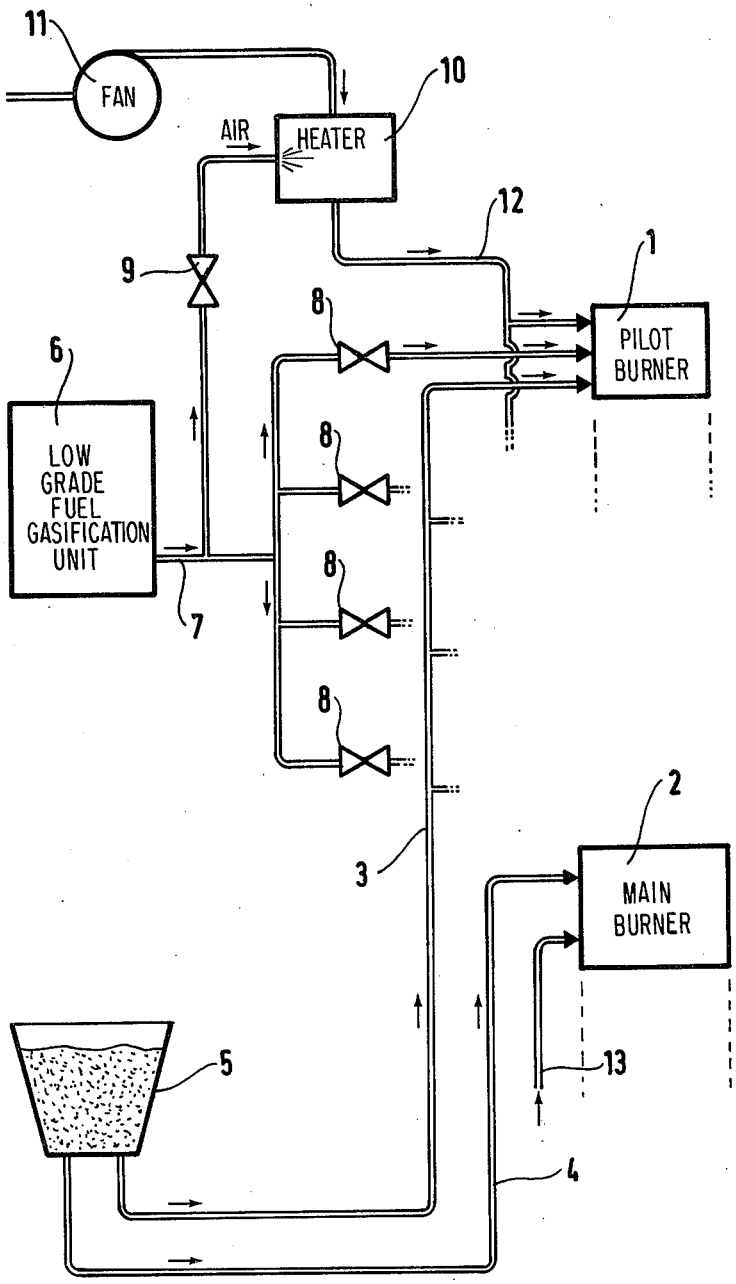
FIG. 1 is a diagram showing the operating principle of an installation which burns only low-grade solid fuel powder.
Figure 2:
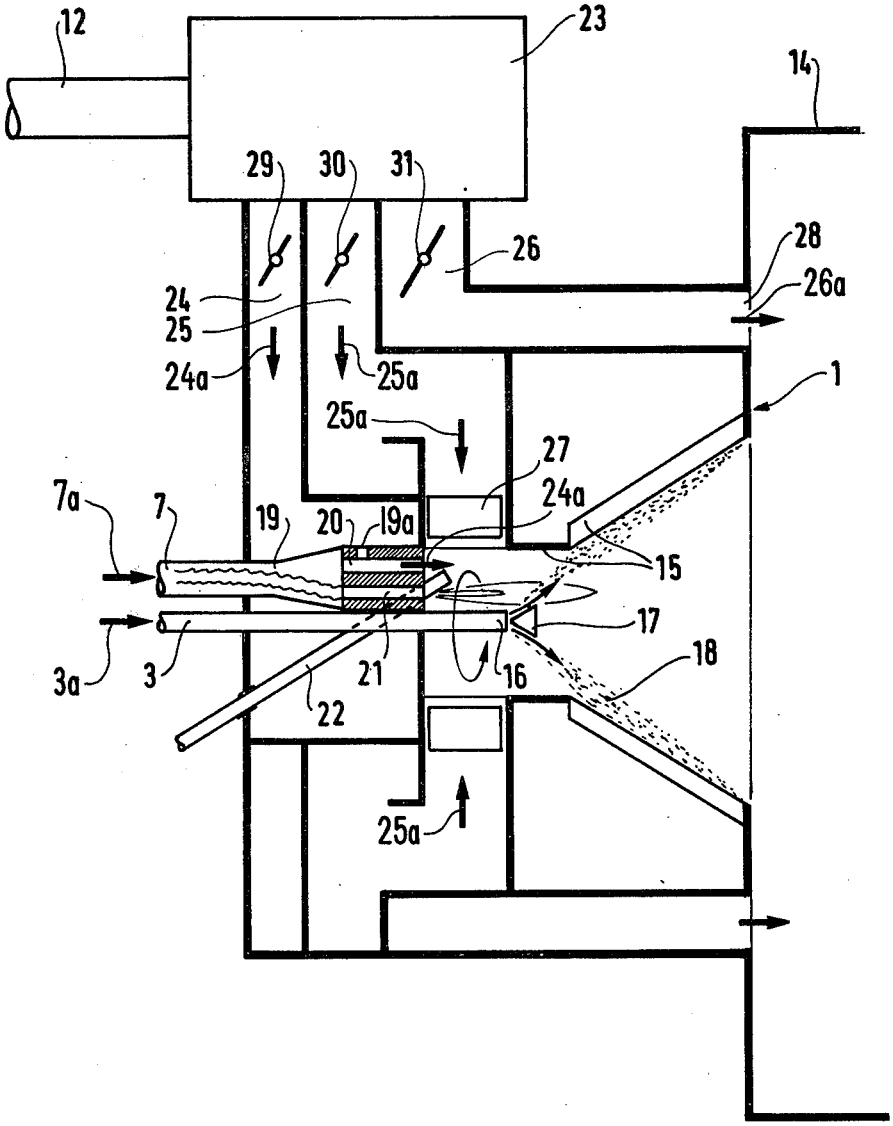
FIG. 2 is a cross-section through a pilot burner.
Figure 3:
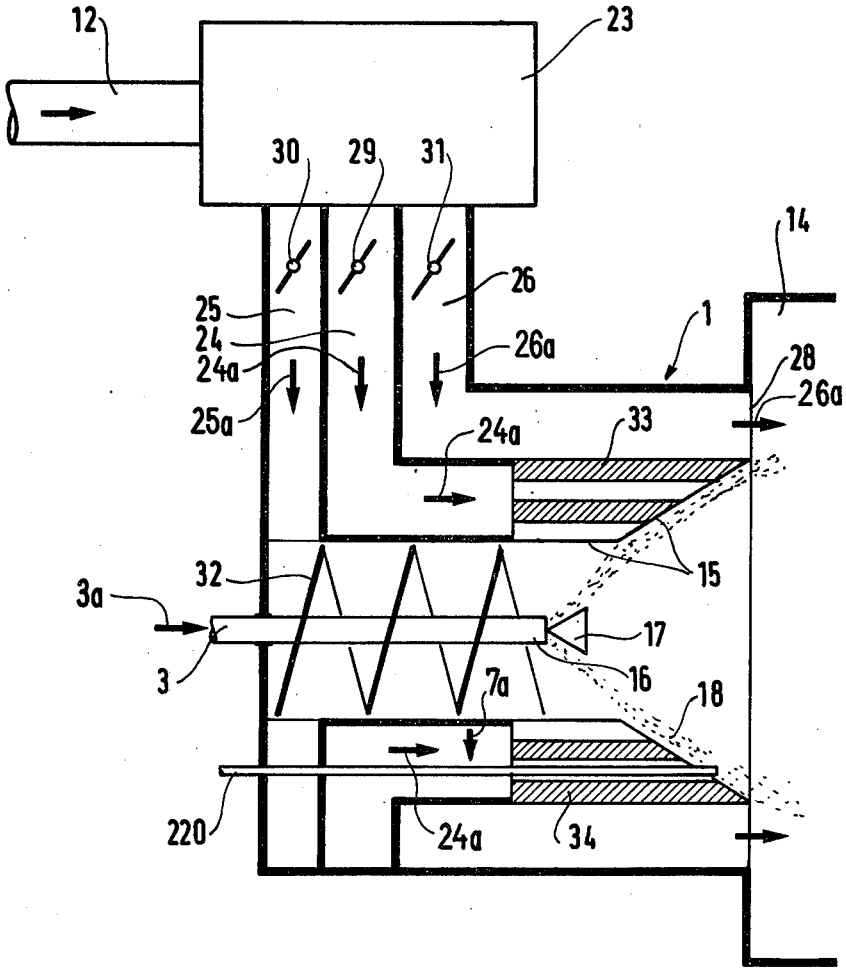
FIG. 3 is a cross-section through a variant pilot burner.

As illustrated in FIG. 1, a plurality of pilot burners 1 (only one of which is shown) and a plurality of main burners 2 (only one of which is shown) receive low-grade solid fuel powder, arrow 3*a*, FIGS. 2, 3, such as low-grade coal, peat or lignite from a storage silo 5 via transport pipes 3 and 4. A low-grade fuel gasification unit 6 produces low-grade gas, arrow *7a*, FIGS. 2, 3, and sends it via transport pipes 7 to each of the pilot burners 1 through distribution cocks such as 8. One of the transport pipes 7 has its flow rate set by a regulating cock 9 and is used to send low-grade gas to an air heater 10 in which the gas is burnt to heat air driven through the heater 10 by a fan 11.

The hot air thus produced is sent via a manifold 12 to the pilot burners 1 so as to supply them with heated combustion air since installations which burn low-grade fuel need heated combustion air. Each main burner 2 also has a combustion air supply circuit 13 which may be reheated in the same way.

It is therefore observed that the fuel is gasified to supply a quantity of gas whose combustion serves to ignite low-grade coal in a boiler either in a cold combustion chamber (on a cold start) or in a hot combustion chamber (when starting after a few hours of non-operation) and also to keep it burning when the boiler is at very low load without any need to add a high-grade fuel such as fuel oil.

FIG. 2 illustrates the pilot burner 1 as a whole, installed in a combustion chamber 14. A portion 15 of the burner 1 is cylindro-conical. The burner 1 has a main igniter 16 fed by the pipe 3 via which the low-grade fuel powder, arrow *3a*, mixed with primary air arrives. The burner 1 is disposed at the end of this pipe. The main igniter 16 has a diffusion cone 17. The axis of the main igniter 16 is the same as that of the cylindro-conical portion 15 and the fuel powder is ejected under pneumatic pressure in a cone referenced 18 which follows the walls of the portion 15. The pilot burner 1 also has an actual igniter 19 for burning and ignition fed with low-grade gas and heated combustion air coming from the manifold 12 via the pipe 7. The pilot igniter 19 takes up a large volume since it burns low-grade gas. It is advantageous to shelter it from the radiation of the chamber upstream from the end of the pipe 3 ending in the main igniter 16. Therefore the pilot igniter 19 occupies a sector of a ring surrounding the main igniter 16 parallel to the axis and to one side thereof. The pilot igniter 19 is of laminated distribution i.e. the low-grade gas and the primary air, arrows *24a*, which enters compartment 20 at *19a*, are distributed in alternate compartments 20 and 21 (20 is an air compartment and 21 is a low-grade gas compartment). The low-grade gas is initially ignited for a very short time, about one minute, by a pipe 22 which supplies either high-grade gas such as propane or else low-grade gas coming from gasification of the fuel itself. The air distribution units include a box 23 for distributing air from the heated air manifold 12. Said units also have means for controlling air flow in ducts 24, 25, 26. The duct 24 is provided to convey primary air *24a*, to the inlet of the low-grade gas pilot igniter 19. The duct 25 is provided to convey secondary air, arrow *25a*, to the outlet of the igniter 15. The duct 25 which conveys so-called secondary air *25a* also includes vanes 27 to rotate the secondary air causing turbulence therein. The duct 26 conveys so-called tertiary air, arrow *26a*, which flows into the combustion chamber 14 via orifices such as 28.

Butterfly valves 29,30, 31 adjust the air flow in the ducts 24, 25, 26.

In the present application of the invention, the pilot igniter 19 fed with low-grade gas, arrow *7a*, and located at the end of the portion of the cylindro-conical chamber 15 is entirely protected from coal flame radiation by the turbulent secondary air during periods when not in use.

FIG. 3 illustrates a variant of the pilot burner 1 which variant differs from the one in FIG. 2 as follows:

the cylindrical part of the cylindro-conical portion 15 of the combustion chamber has a helical screw 32 which surrounds the main igniter 16. The screw 32 is disposed in the duct 25 to ensure turbulence in the secondary air supplied to the outlets of the low-grade gas igniters;

low grade gas igniters 33, 34 (there are two in all) communicate with the conical part of the portion 15 of the chamber. They are disposed in two ring sectors which surround the main igniter 16 in a direction parallel to the axis thereof and downstream from its end. In a manner similar to that illustrated in FIG. 2, alternate layers of low-grade gas, arrow *7a*, and of air, arrow *24a*, conveyed by the duct 24, are set up at the ends of the pilot igniters 33, 34; and an ignition rod 220 is disposed in a direction parallel to the axis of the apparatus and communicates with the conical part of the combustion chamber 15.

In the present variant which is based on the same principle as the one illustrated in FIG. 2, when the pilot igniters 33, 34 are not in use, the layers of air at their ends provide extra combustion air for the powdered fuel of the pilot burner.

Figure 4:
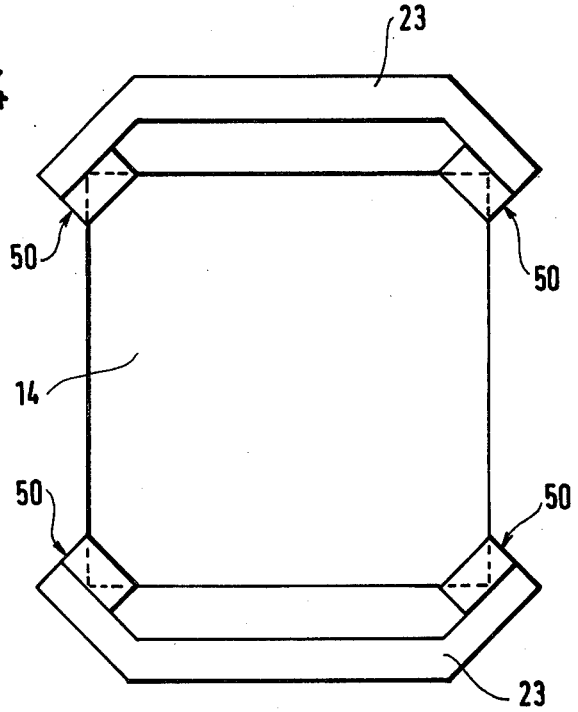
FIG. 4 is a diagrammatic plan of a combustion chamber with its burner units.
Figure 5:
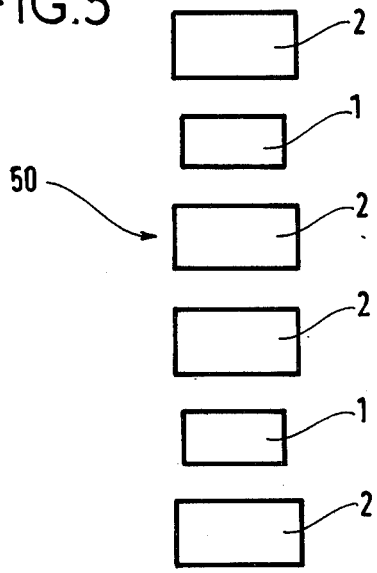
FIG. 5 is a diagrammatic elevation of the burners of the burner unit shown in FIG. 4.

FIGS. 4 and 5 illustrate a possible disposition of the burner units 50 constitued by an arrangement of main burners 2 disposed on either side of the pilot burners 1. The burner units 50 are located in the angles of the combustion chamber 14 which is parallelepipedical. The combustion air is distributed to the various burners by the boxes such as 23.

Figure 6:
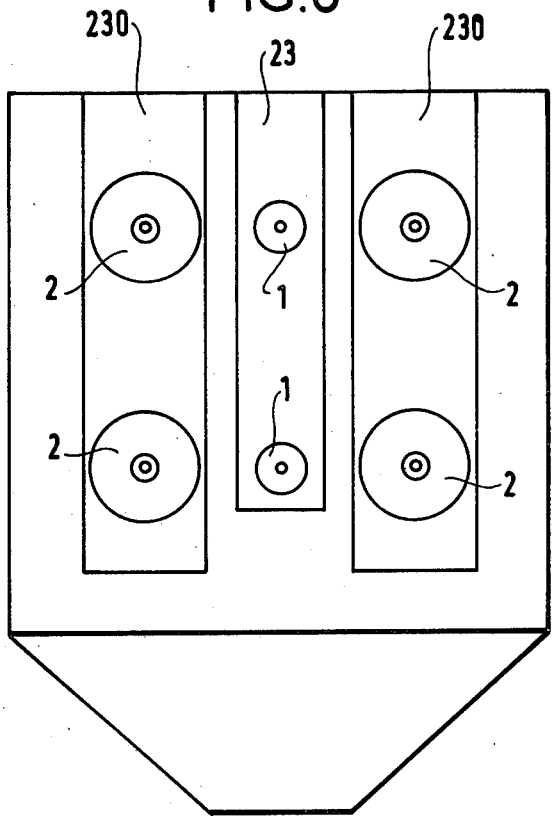
FIGS. 6 and 7 are respectively an elevation and a plan of a variant burner configuration.
Figure 7:
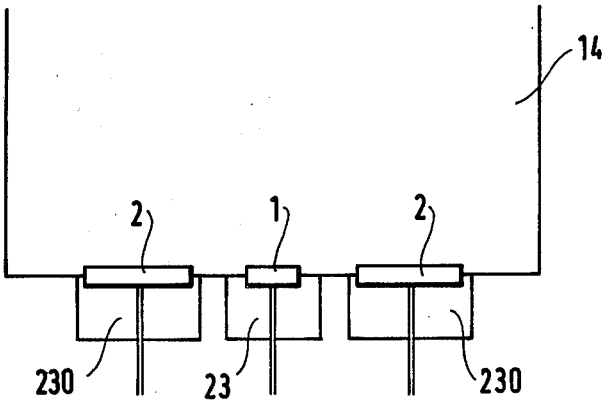

FIGS. 6 and 7 show another possible disposition of the burners in which disposition the pilot burners 1 and the main burners 2 are located on an outer surface of the combustion chamber 14. The combustion air of the pilot burners 1 is distributed from the boxes 23. The combustion air of the main burners is distributed from boxes 230.

The apparatus in accordance with the present invention applies in particular to combustion apparatus for steam generators in thermal power stations, but is generally applicable to all kinds of combustion apparatus burning low grade fuel.

We claim:

1. Ignition apparatus for directly igniting low-grade solid fuel powders in cold combustion chambers, said apparatus comprising at least one pilot burner with at least one pilot igniter and at least one main igniter, said at least one main igniter being fed with low-grade fuel powders, the improvement comprising:

means for feeding said pilot igniter with low-grade gas from a gasifying unit gasifying said low-grade fuel powders to eliminate adding any auxiliary high-grade fuel.

2. Ignition apparatus according to claim 1, comprising a combustion chamber body having a cylindro-conical portion, which includes both air distribution units to facilitate combustion, and at least one pilot burner constituted by a pilot igniter and a main igniter which is fed by a pipe which brings in air and fuel powder and whose outlet is disposed axially relative to the cylindro-conical portion of the combustion chamber, and wherein said low-grade gas pilot igniter is disposed upstream from said end of the fuel powder pipe in a position parallel to and to one side of said pipe.

3. Ignition apparatus according to claim 1, comprising a combustion chamber body having a cylindro-conical portion which includes both air distribution units to facilitate combustion, and at least one pilot burner constituted by a pilot igniter and a main igniter which is fed by a pipe which brings in air and fuel powder and whose outlet is disposed axially relative to the cylindro-conical portion of the combustion chamber, and wherein at least one low-grade gas pilot igniter is disposed downstream from said end of the fuel powder pipe in a direction parallel to said pipe and having its outlet at a portion of the side surface of the conical part of the cylindro-conical portion of the combustion chamber.

4. Ignition apparatus according to claim 2 or 3, wherein said air distribution units is preceded by an air heater which burns low-grade gas produced by said gasifying unit and includes means for supplying heated air to said pilot burner.

5. Ignition apparatus according to claim 4, wherein said heated air supply means comprises means for feeding said heated air to the inlet of said pilot igniter at the same time as the low-grade gas, and said apparatus further includes means for feeding secondary air in which turbulance is set up to its outlet.

6. Ignition apparatus according to claim 5, wherein vanes disposed perpendicularly to the outlet of said pilot igniter of low-grade gas makes said secondary air rotate to set up the secondary air turbulance.

7. Ignition apparatus according to claim 5, wherein a helical screw disposed concentrically around said low-grade fuel powder pipe sets up the turbulance of said secondary air.

8. Ignition apparatus according to claims 1 or 7 wherein said pilot burners are disposed between two main burners which are adjacent to them.

9. Ignition apparatus according to claim 8, wherein the combustion chamber is parallelepipedical, and the burner units constituted by said pilot igniters and main igniters are located in the corners of the combustion chamber.

10. Ignition apparatus according to claim 8, wherein the combustion chamber is parallelepipedical, and the burner units constituted by said pilot burners and main burners are located on one surface of the combustion chamber.

* * * * *